United States Patent [19]

Luey et al.

[11] 4,050,499

[45] Sept. 27, 1977

[54] HEAD BOX FOR CYLINDER MOLDS HAVING A FLEXIBLE LID ELEMENT

[75] Inventors: A. Thomas Luey, Kalamazoo, Mich.; Frederick S. Hite, Downingtown, Pa.

[73] Assignee: Boxboard Research and Development Association, Kalamazoo, Mich.

[21] Appl. No.: 654,237

[22] Filed: Jan. 29, 1976

Related U.S. Application Data

[63] Continuation of Ser. No. 486,303, July 8, 1974, abandoned.

[51] Int. Cl.[2] ..... D21F 1/06

[52] U.S. Cl. ..... 162/317; 162/336; 162/347

[58] Field of Search ..... 162/317, 214, 336, 347, 162/339, 344

[56] References Cited

U.S. PATENT DOCUMENTS

| | | | |
|---|---|---|---|
| 1,928,107 | 9/1933 | Lang | 162/336 X |
| 2,329,799 | 9/1943 | Thorsen | 162/339 X |
| 2,677,991 | 5/1954 | Goumeniouk | 162/344 X |
| 3,072,180 | 1/1963 | Jodrey | 162/347 X |
| 3,313,681 | 4/1967 | Dennis et al. | 162/336 X |
| 3,575,799 | 4/1971 | Gedemer et al. | 162/347 X |
| 3,661,702 | 5/1972 | Means | 162/336 X |
| 3,839,149 | 10/1974 | Justus et al. | 162/317 |
| 3,853,695 | 12/1974 | Back et al. | 162/347 X |

*Primary Examiner*—S. Leon Bashore
*Assistant Examiner*—Marc L. Caroff
*Attorney, Agent, or Firm*—Fitch, Even, Tabin & Luedeka

[57] ABSTRACT

A head box for use with a cylinder type papermaking machine which includes a dispersion chamber having a fiber stock discharge outlet disposed adjacent the surface of the cylinder mold. A lid element extends downstream from the stock outlet in spaced relation to the cylinder mold and has a trailing edge portion capable of flexing to maintain a desired pressure within a pressurized stock formation area established between the lid element and the mold surface notwithstanding pressure changes within the dispersion chamber. Means are provided to selectively vary the spatial relationship of the lid element relative to the surface of the cylinder mold.

9 Claims, 6 Drawing Figures

HEAD BOX FOR CYLINDER MOLDS HAVING A FLEXIBLE LID ELEMENT

This is a continuation of application Ser. No. 486,303, filed July 8, 1974, now abandoned.

The present invention relates generally to fibrous web making machines, such as papermaking machines and the like, and more particularly to novel head box means for use with a cylinder type papermaking machine.

In cylinder type papermaking machines, a fibrous web or sheet is formed on the peripheral surface of a rotatable cylinder mold whereafter the fibrous web is picked up by a wet felt and carried to presses, dryers, calenders and thence to reels and a winder or sheet cutter in a known manner. The surface of the cylinder mold generally comprises a fine wire cloth, such as a fine mesh Fourdrinier wire.

In the early development of cylinder type papermaking machines, it was a conventional practice to partially suspend the cylinder mold into a vat of fiber stock. Rotation of the cylinder mold caused the fiber stock to be picked up by the peripheral surface of the cylinder mold as the water passed through the wire surface of the mold to form a fibrous web or paper sheet over the entire length of the cylinder mold whereafter the fibrous web or paper sheet was picked up and carried to the press rolls by the wet felt. The present invention is directed to improved means for depositing fibrous stock onto the peripheral surface of a cylinder mold to form a fibrous web or paper sheet on the cylinder mold without suspending the cylinder mold in a vat of fiber stock.

In accordance with the present invention, a head box is provided for use with a cylinder type papermaking machine to form an even layer of fiber stock onto the peripheral surface of a cylinder mold in a highly efficient and economical manner.

One of the primary objects of the present invention is to provide a head box for use with a cylinder type papermaking machine and the like, which head box includes novel means for obtaining an even layer of fiber stock on the peripheral surface of the rotatable cylinder mold.

Another object of the present invention is to provide a head box for use with a cylinder type papermaking machine and the like wherein a novel lid element is supported in spaced relation to the cylinder mold adjacent a stock outlet of a dispersion chamber and serves to maintain a desired stable pressure within a pressurized stock formation area between the lid and cylinder generally independently of pressure variations within the dispersion chamber whereby to accommodate cylinder mold surfaces that are not perfectly round.

Another object of the present invention is to provide a head box for use with a cylinder type papermaking machine and the like, which head box employs a lid element which extends downstream from a stock discharge opening in a dispersion chamber and is spaced from the surface of the cylinder mold, the lid element forming a pressurized stock formation area between the lid element and the cylinder mold and having a flexible downstream edge portion responsive to the pressure within the stock formation area to vary the spatial relation of the lid element to the cylinder mold and establish an even fiber layer or web on the cylinder mold.

A feature of the present invention lies in the provision of means for selectively varying the spatial relation of the lid element to the peripheral surface of the cylinder mold.

Another feature of the present invention lies in the provision of means for adjusting the trailing edge of the lid element relative to the cylinder mold surface so as to "profile" the trailing edge of the lid element to the mold surface.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
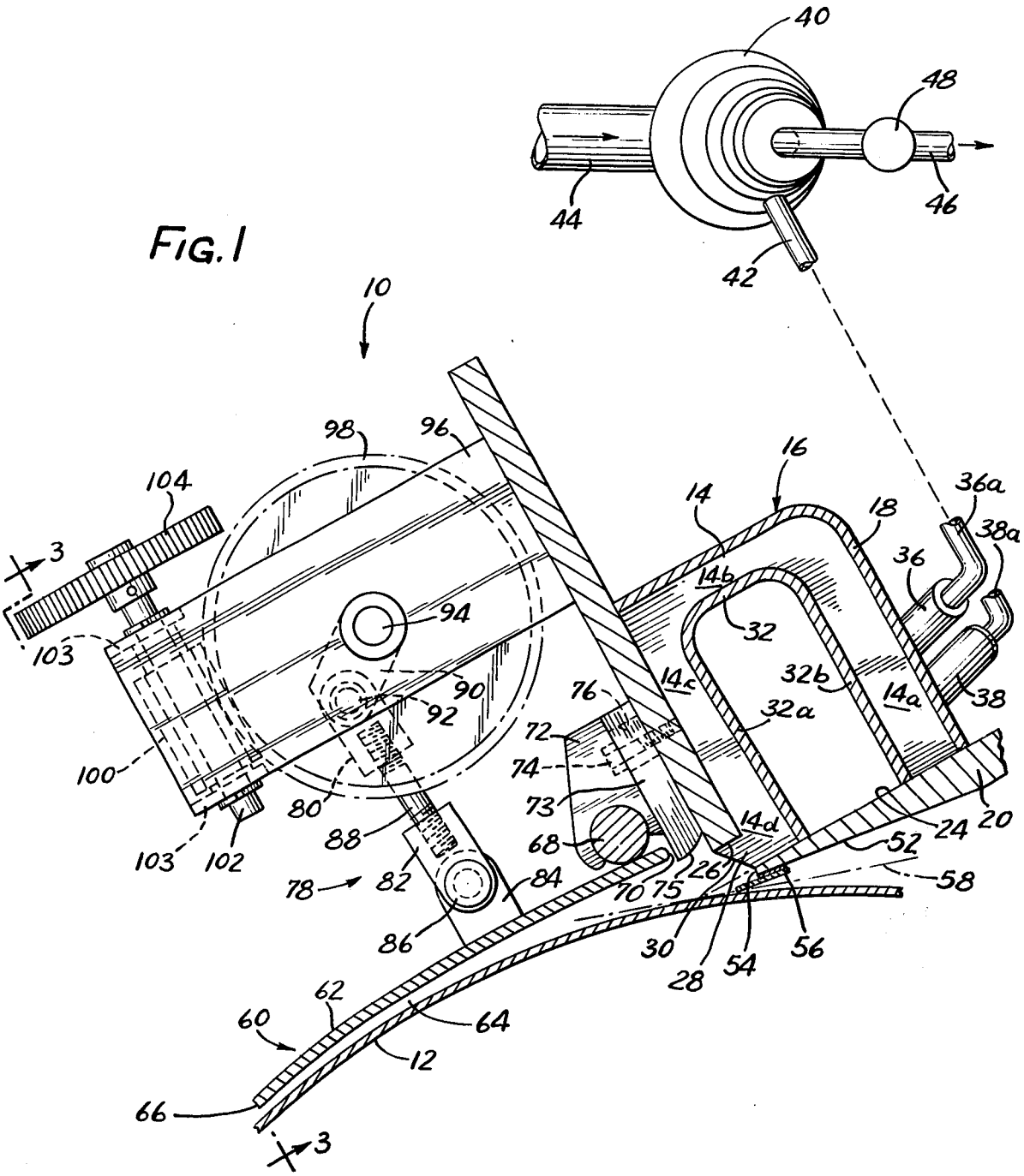
FIG. 1 is a transverse sectional view of a head box in accordance with the present invention shown in operative association with a cylinder mold as employed in a cylinder type papermaking machine.

Referring now to the drawings, and in particular to FIG. 1, head box means constructed in accordance with one embodiment of the present invention is indicated generally at 10. The head box means 10 is illustrated, by way of example, in cooperative relation with a cylinder mold, a portion of which is indicated at 12, which forms a part of a conventional cylinder type fibrous web making machine such as a papermaking machine or the like. The cylinder mold 12 is conventionally supported for rotation about its longitudinal axis which is disposed in transverse relation to the main longitudinal axis of the papermaking machine with which the cylinder mold 12 is employed. The cylinder mold 12 conventionally extends the full transverse width of the papermaking machine.

The head box means 10 is adapted to discharge a fibrous stock suspension onto the peripheral surface of the cylinder mold 12 to form a fibrous web or layer on the peripheral surface of the cylinder mold which is thereafter removed by a wet felt (not shown) and transferred to pressure rollers, dryers, calenders and thence to the winder reels and sheet cutters in a known manner. The peripheral surface of the cylinder mold 12 upon which fibrous stock is deposited to form the fibrous web layer is generally formed by a fine mesh wire, such as a relatively fine mesh Fourdrinier wire.

The head box means 10 includes an internal dispersion chamber 14 defined within a dispersion chamber housing, indicated generally at 16. The dispersion chamber housing 16 includes an inverted L-shaped housing wall 18 which has its bottom longitudinal edge secured to a base plate 20, such as by welding, and has its opposite longitudinal edge secured to a planar support plate 22 by suitable means such as welding. The support plate 22 lies in a plane perpendicular to the plane of an upper planar surface 24 of the base plate 20, and has a lower edge surface 26 disposed parallel to the axis of rotation of the cylinder mold 12 and spaced from the upper surface 24 of the base plate 20 to define a discharge throat or outlet opening 28 for the dispersion chamber housing 16. The discharge throat 28 extends the full longitudinal length of the chamber housing 16 which, in turn, extends substantially the full longitudinal length of the cylinder mold 12. The chamber housing 16 has vertically disposed end plates, one of which is shown at 30, secured to the opposite ends of the housing wall 18, the base plate 20 and the support plate 22 to enclose the ends of the internal dispersion chamber 14. The head box means 10 may be supported on the papermaking machine in the desired relation to the cylinder mold 12 by any suitable known means.

A generally inverted U-shaped wall 32 is disposed within the dispersion chamber 16 and has its depending wall portions 32a and 32b secured to the upper surface 24 of the base plate 20 so as to define an inverted U-shaped internal dispersion chamber 14, when considered in transverse cross section as in FIG. 1. As will become more apparent below, the dispersion chamber 14 establishes a relatively narrow passage having alternately disposed restricted and expanded flow areas through which the fiber stock suspension is caused to flow prior to discharge from the discharge throat 28.

A plurality of pairs of inlet tubes 36 and 38 are connected to the depending wall portion of the housing member 18 such that each pair of inlet tubes 36 and 38 are in communicating relation with the internal dispersion chamber 14 of the chamber housing 16 at a position spaced upstream from the discharge throat 28, considered in the upstream direction of fiber stock flow through the dispersion chamber 14 as will be described more fully below.

Figure 2:
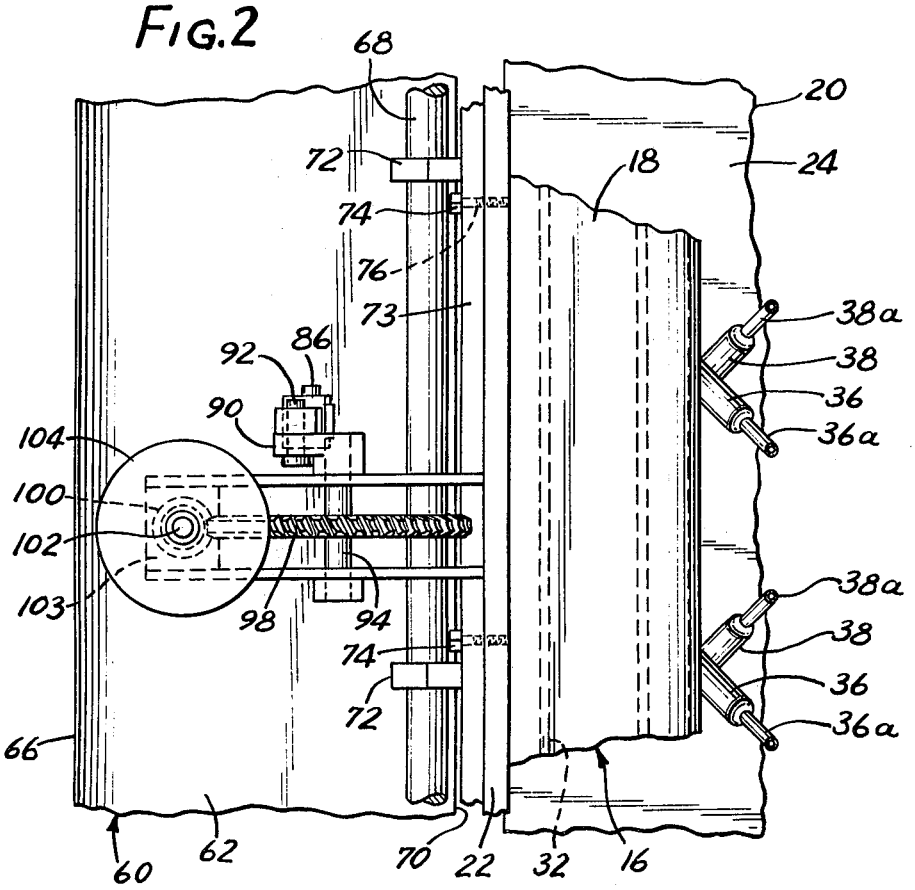
FIG. 2 is a partial plan view of the head box illustrated in FIG. 1.

Noting FIG. 2 taken in conjunction with FIG. 1, the inlet tubes 36 and 38 of each pair of inlet tubes intersect the housing member 18 such that the axes of each pair of inlet tubes are disposed in vertical alignment one above the other, with the pairs of inlet tubes 36 and 38 being spaced in longitudinally aligned relation along the housing member 18 on approximately 4¼ inch centers. Considered in the plane of FIG. 1, the axis of each of the inlet tubes 36 and 38 is inclined upwardly approximately 15° from the plane normal to the depending wall of housing member 18 at the point of connection of the respective inlet tubes to the housing member 18. As considered in FIG. 2, the inlet tubes 36 and 38 of each pair of inlet tubes diverge outwardly from each other so as to form an included angle therebetween of approximately 90°, the axis of each of the inlet tubes at its point of intersection with the housing member 18 lying in a plane forming an included angle of approximately 45° with a plane perpendicular to the housing member 18.

Fibrous stock is supplied through the inlet tubes 36 and 38 from a tapered cross-flow pipe 40 which is of substantially equal longitudinal length to the dispersion chamber housing 16 and is supported to generally overlie the dispersion chamber housing in parallel relation to the axis of rotation of the cylinder mold 12. The tapered cross-flow pipe 40 is of conventional design and has a plurality of depending supply tubes, one of which is shown at 42, each of which is connected to an upwardly directed end portion, such as **36*a* and 38*a*, of one of the inlet tubes 36 and 38. In this manner, fiber stock suspension introduced into the tapered cross-flow pipe 40 will be supplied to the pairs of inlet tubes 36 and 38 and thus into the internal dispersion chamber 14 within the dispersion chamber housing 16. The tapered cross-flow pipe 40 receives fiber stock from a supply pipe 44 and has an auxiliary discharge tube or pipe 46 connected to the reduced diameter end portion thereof to assist in the control of stock to the supply tubes 42 by means of a control valve 48**.

The dispersion chamber housing 16 and associated base plate 20 and support plate 22 are supported by the frame structure of the papermaking machine (not shown) in a manner to allow the dispersion chamber housing to be raised and lowered relative to the cylinder mold 12 whereby to vary the spatial relation of the discharge throat 28 relative to the outer peripheral cylinder mold 12. To this end, the base plate 20 has a lower tapered surface 52 having an edge surface or lip 54 defining the lower horizontal edge of the discharge throat 28. The inclined surface 52 on the base plate 20 allows the lip edge surface 54 to be brought into close proximity to the peripheral surface of the cylinder mold 12. A relatively thin narrow seal strip 56 made of a suitable flexible material such as rubber is secured to the edge of the tapered surface 52 adjacent the lip surface 54 and extends rearwardly or downstream from the lip surface 54 sufficiently to engage the peripheral surface of the cylinder mold 12 in sliding sealing contact therewith, it being understood that the seal strip 56 extends the full longitudinal length of the discharge throat 28.

In addition to being supported for adjustment toward and away from the peripheral surface of the cylinder mold 12, the dispersion chamber housing 16 is also supported for angular adjustment relative to the cylinder mold 12, considered in the plane of FIG. 1. In the illustrated embodiment, the dispersion chamber housing 16 is adjusted so that the plane of the upper surface 24 of the base plate 20 forms an included angle of approximately 15° with a plane, indicated by the line 58, tangent to the peripheral surface of the cylinder mold 12 at the line of intersection of the plane of surface 24 with the peripheral surface of the cylinder mold 12.

As thus far described, it can be seen that fiber stock introduced into the internal dispersion chamber 14 of the dispersion chamber housing 16 through the pairs of inlet tubes 36 and 38 from the cross-flow pipe 40 will be caused to flow through the relatively narrow flow passage of the internal dispersion chamber 14 to the discharge throat 28 whereupon the fiber stock is discharged through the discharge throat onto the peripheral surface of the cylinder mold 12.

In accordance with the present invention, the head box means 10 includes lid means, indicated generally at 60, pivotally connected to the dispersion chamber housing 16 and adapted to be supported in spaced relation from the peripheral surface of the cylinder mold 12 downstream of the discharge throat 28. The lid means 60 includes a lid element 62 which has a generally concave transverse curvature, considered relative to the cylinder mold 12, and extends the full longitudinal length of the discharge throat 28. The radius of curvature of the concave lid element 62 is preferably slightly greater than the radius of the associated cylinder mold 12. For example, if a cylinder mold 12 having a diameter of 42 inches is selected, the lid element 62 preferably is formed to comprise an arcuate segment of a cylindrical tube having a diameter of approximately 44 inches.

The lid element 62 is supported in outward spaced relation from the peripheral surface of the cylinder mold 12 so as to establish a pressurized stock formation area 64 between the lid element 62 and the peripheral surface of the cylinder mold 12, the pressurized formation area 64 extending from substantially the discharge throat 28 downstream to a trailing longitudinal edge 66 on the lid element 62, as considered in FIG. 1.

The lid element 62 is preferably supported in a manner to allow selective adjustment of the spatial relation of the lid element to the peripheral surface of the cylinder mold 12. To this end, a pivot shaft 68 having a longitudinal length substantially equal to the longitudinal length of the lid element 62 is secured to the upper surface of the lid element adjacent a leading edge portion 70 thereof by suitable means such as welding or the like. The pivot shaft 68 is pivotally supported by a plurality of support brackets 72 each of which is secured to a transverse support bar 73 which, in turn, is adjustably mounted on the support plate 22 through a plurality of support bolts 74. Each of the support bolts 74 is received through a vertically elongated slot 76 in the associated support bar 73 and has a threaded end portion fixedly received within a suitable threaded aperture in the support plate 22. The support brackets 72 are spaced longitudinally along the length of the support bar 73. By adjustment of the support bar 73 relative to the support plate 22, a lower contoured edge surface 75 on the bar 73 may be selectively positioned relative to the planar surface 24 of the base plate 20 to vary the size of the discharge throat 28 through which fibrous stock is discharged from the dispersion chamber 14. Similarly, adjustment of the support bar 73 serves to vary the spacing of the leading edge 70 of the lid element 62 relative to the peripheral surface of the cylinder mold 12. It will be understood that the support bar 73 is adjusted to maintain the pivot shaft 68 in substantially parallel relation to the axis of rotation of the cylinder mold 12.

With the lid element 62 being pivotally supported by the dispersion chamber housing 16 through the pivot shaft 68, a plurality of lid support and adjustment mechanisms, one of which is indicated generally at 78, are provided in longitudinal spaced relation along the length of the lid 62 to selectively adjust the spatial relation of the lid element 62 relative to the peripheral surface of the cylinder mold 12 downstream from the pivot shaft 68. The support mechanisms 78 each includes a linkage rod 80 having opposite hand threaded ends the lower of which is threadedly connected to a bifurcated end bracket 82. The bracket 82 is pivotally connected to a bracket member 84 through a pivot pin 86, the bracket member 84 being suitably secured to the outer surface of the lid element 62 opposite the surface thereof facing the cylinder mold 62. The upper threaded end of the linkage 80, as considered in FIGS. 1 and 3, has a bifurcated member 88 threadedly secured thereon which is pivotally secured to a crank arm 90 through a pivot pin 92. The crank arm 90 is affixed on a horizontally disposed support shaft 94 having its ends rotatably supported within parallel spaced vertical plate members 96. The plate members 96 are secured in perpendicular relation to the support plate 22 so as to extend outwardly therefrom in generally overlying relation to the lid element 62. It can be seen that the spatial relationship of the lid element 62 relative to the cylinder mold 12 can be adjusted as desired by selective rotation of the support shaft 94 and also by rotation of the linkage rods 80.

Figure 3:
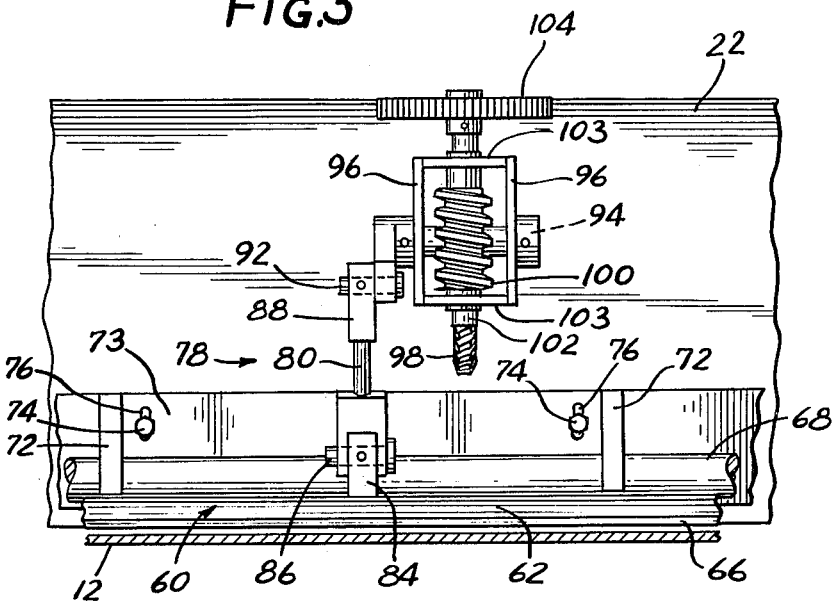
FIG. 3 is a partial rear view taken substantially along the line 3—3 of FIG. 1.

In accordance with the embodiment illustrated in FIGS. 1-3, the support mechanisms 78 are manually adjustable to selectively vary the spatial relationship of the lid element 62 relative to the cylinder mold 12. To this end, a circular worm gear 98 is fixedly secured to the support shaft 94 and is cooperative with a worm 100 supported on a worm support shaft 102 which, in turn, is supported by parallel plates 103 formed integral with or secured to the upper and lower edges of the support plates 96. The worm support shaft 102 has a circular wheel 104 secured to its upper end which allows manual rotation of the worm support shaft 102 with a corresponding rotation of the worm 100 whereby to effect rotational movement of the worm gear 98 to selectively rotate the support shaft 94 and thereby vary the spatial relationship of the lid element 62 relative to the cylinder mold 12. It will be understood that the shaft 94 may extend substantially the full length of the lid element 62 such that only one worm gear 98 and associated control worm 100 and wheel 104 need be provided to rotate the shaft 94 to raise and lower the lid element 62. With such an arrangement, the individual linkage rods 80 may be selectively rotated to vary the contour of the lid element 62 along its length to compensate for warpage and wear of the cylinder mold 12.

While the lid support and adjustment mechanism 78 has been described as including means to manually adjust the spatial relationship of the lid element 62 to the cylinder mold 12, it will be understood that other means, such as hydraulic or pneumatic cylinder means, may be suitably adapted for adjusting the spaced relationship of the lid element 62 to the cylinder mold 12. Still further, it is contemplated that remote control means might be operatively associated with the lid element 62, such as through a hydraulic or pneumatic cylinder, to remotely control the spatial relationship of the lid element 62 to the cylinder mold 12 in response to the pressure changes within the pressurized stock formation area 64 or within the dispersion chamber 14.

The bracket members 84 are secured to the upper surface of the lid element 62 in positions such that substantially one-half of the transverse width of the lid element, as considered in the plane of FIG. 1, extends rearwardly from the bracket members 84 so as to be freely suspended in cantilever fashion. The lid element 62 is of predetermined vertical thickness and is made of a material capable of predetermined flexing in relation to variations in pressure within the pressurized stock formation area 64 established between the lid element 62 and the peripheral surface of the cylinder mold 12.

By way of example only, one embodiment of the head box means 10 in accordance with the present invention employs a cylinder mold 12 having a diameter of 42 inches. The lid element 62 is formed with a radius of curvature of 22 inches and has a transverse arcuate width of approximately 8 inches. The lid element 62 is made of stainless steel having a vertical thickness of approximately 3/16 inch. The bracket member 84 is secured to the upper surface of the lid element 62 such that approximately 4 inches of the transverse width of the lid element 62 extends downstream from the bracket member 84 to provide a predetermined degree of flexibility. In this manner, the lid element 62 is self-accommodating to varying operating conditions, and specifically to variations in the pressure within the pressurized stock formation area 64. Additionally, the flexibility characteristics of the cantilevered trailing portion of the lid element 62 serve to compensate for out-of-round peripheral surface irregularities of the cylinder mold 12.

To effect desired dispersion of the fiber stock within the dispersion chamber 14, a path portion **14*a* into which fiber stock is introduced from $\frac{3}{4}$ inch diameter inlet tubes 36 and 38 has a width of approximately 1 inch, considered in the plane of FIG. 1. The upper path portion 14***b* of the dispersion chamber 14 has a height of approximately ⅝ inch. The fiber stock path in the dispersion chamber 14 is thereafter reduced to approximately ½ inch width at 14*c*, and enlarged again at 14*d* to approximately ⅝ inch whereafter the fiber stock is discharged through the restricted discharge throat 28 which has a height of approximately ½ inch, considered between the lower edge 26 of the support plate and the surface 24 of the base plate 20. The support bar 73 may be adjusted to provide a discharge throat opening having a height of as little as ¼ inch, although ½ inch is preferable.

In this manner, each unit volume of fiber stock introduced into the dispersion chamber 14 is caused to pass sequentially through restricted and expanded flow areas prior to discharge from the slice outlet 28, whereby to enhance the turbulence of the fiber stock flow within the dispersion chamber.

The dispersion chamber housing 16 is positioned such that the forward lip surface 54 of the base plate 20 is approximately 3/16 inch from the peripheral surface of the cylinder mold 12. As noted, the upper planar surface 24 of the base plate 20 is preferably inclined at an angle of 15° to a plane 58 tangent to the peripheral surface of the cylinder mold 12 at the line of intersection of the plane of the surface 24 of the base plate 20 with the cylinder mold. Preferably, a minimum fiber stock velocity of 200 ft. per min. is maintained through the discharge throat 28 of the dispersion chamber housing 16 which will produce a pressure at the top of the internal dispersion chamber 14 of at least 10 inches water. The consistency of the fiber stock employed in the system may range from approximately about 0.5% to about 1.2% depending upon the weight of the web sheet being made in relation to the speed of the cylinder mold 12. Under these conditions, the trailing edge 66 of the lid element 62 may be initially set to provide a clearance or spaced relation of between approximately zero to 0.110 inch between the trailing edge 66 and the peripheral surface of the cylinder mold 12. This will result in a clearance between the lid element 62 and the peripheral surface of the cylinder mold 12 of approximately about 0.070 inch ±0.040 inch during operation.

In accordance with the present invention, the dimensional clearance of the trailing edge 66 of the lid element 62 relative to the peripheral surface of the cylinder mold 12 will vary in accordance with the pressure within the internal dispersion chamber 14 generally as follows: With a pressure of 5 inches water measured at the upper path 14*b* of the dispersion chamber 14, the trailing edge 66 of the lid element 62 will be spaced approximately 0.010 inch above the cylinder mold 12; at 10 inches water pressure at 14*b*, the lid trailing edge 66 will be spaced approximately 0.035 inch above the peripheral surface of the cylinder mold 12; at 15 inch water pressure at 14*b*, the trailing edge 66 will be spaced approximately 0.055 inch above the peripheral surface of the cylinder mold; at 20 inch water pressure at 14*b*, the trailing edge 66 will be spaced approximately 0.070 inch above the cylinder mold surface, and at 30 inch water pressure at 14*b*, the trailing edge 66 will be spaced approximately 0.110 inch above the cylinder mold surface. These dimensional figures are only by way of example. The actual clearance of the lid element 62 from the cylinder mold 12 will be dependent upon the initial setting of the lid under static zero-pressure conditions.

Figure 4:
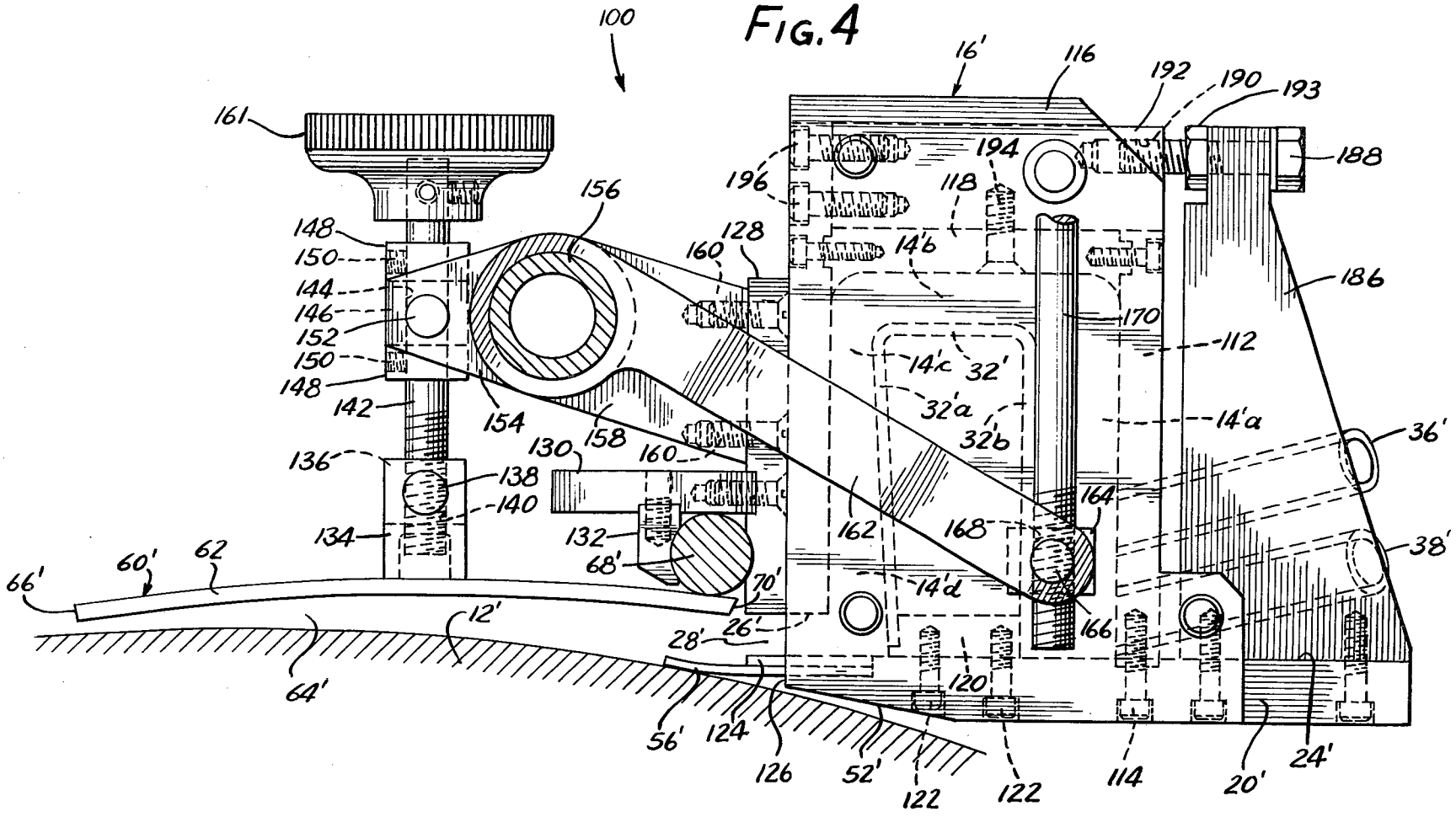
FIG. 4 is an end elevational view of another embodiment of a head box in accordance with the present invention, a portion of the lid element adjustment mechanism being removed for clarity.
Figure 5:
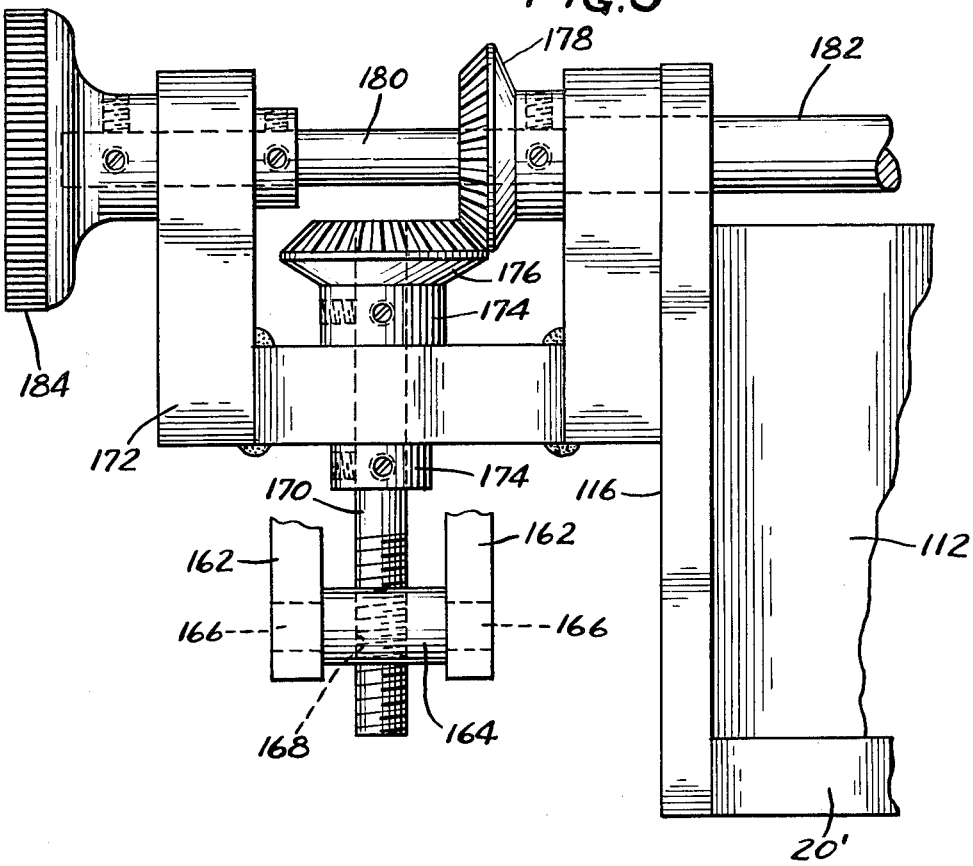
FIG. 5 is a partial front view showing a portion of the adjustment mechanism for use with the head box of FIG. 4.
Figure 6:
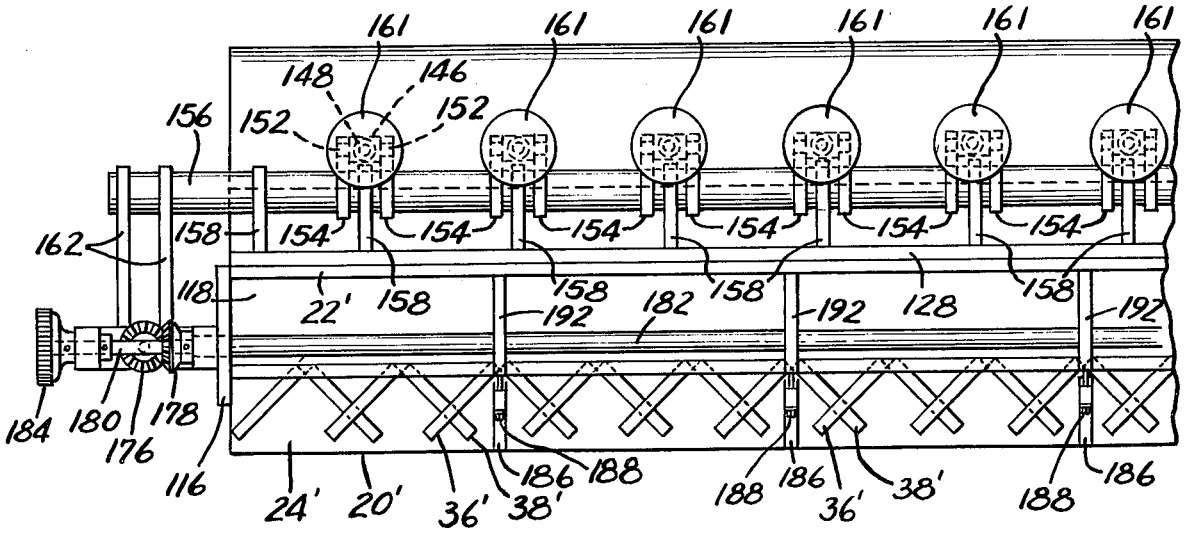
FIG. 6 is a partial plane view of the head box shown in FIG. 4.

FIGS. 4–6 illustrate an alternative embodiment of head box means in accordance with the present invention. The alternative embodiment of FIGS. 4–6 is indicated generally at 110. The head box means 110 is generally similar to the aforedescribed head box means 10 and those elements of the head box means 110 which are substantially similar to corresponding elements of the head box means 10 are indicated by the same reference numeral but having a prime superscript. In this respect, the head box means 110 includes a dispersion chamber housing 16' supported in cooperative relation with a cylinder mold, a portion of which is indicated at 12', which may form a part of a conventional cylinder type fibrous web papermaking machine. The head box means 110 is adapted to discharge a fibrous stock suspension onto the peripheral surface of the cylinder mold 12' to form a fibrous web or layer on the cylinder mold in similar fashion to the head box means 10.

The dispersion chamber housing 16' includes a base plate 20' which has secured to its upper surface 24' a transversely extending plate 112 through suitable means such as bolts 114. A pair of end plates, one of which is indicated at 116, are secured to the lateral edges of the base plate 20 and abut the lateral end surfaces of the upstanding plate 22. An upper chamber plate 118 is secured between the upstanding plate 112 and a support plate 22', both the upper chamber plate 118 and support plate 22' extending the full transverse distance between the upstanding end plates 116. The base plate 20', upstanding plate 112, chamber plate 118 and support plate 22' define an internal dispersion chamber 14' within which is mounted a generally inverted U-shaped wall 32' having wall portions 32'*a* and 32'*b* the lower edges of which are secured to a support block 120 mounted on the upper surface 24' of the base plate 20' by suitable means such as cap screws 122. The inverted U-shaped wall 32 cooperates with the inner surfaces of the upstanding plate 112, the upper chamber plate 118 and the inner surface of the support plate 22' to define a generally inverted U-shaped internal dispersion chamber 14 having alternately disposed flow restriction and expansion areas 14'*a*, 14'*b*, 14'*c* and 14'*d* similar to the above described internal dispersion chamber 14. The dispersion chamber 14 receives fiber stock suspension from pairs of inlet flow tubes 36' and 38' which are supported within suitable openings in the upstanding plate 112, the inlet tubes 36' and 38' being angularly related to the plane of the plate 112 similar to the angular mounting of the above described inlet tubes 36 and 38. The inlet tubes 36' and 38' to receive fibrous stock suspension from a suitable cross flow pipe such as that shown at 40 in FIG. 1.

The discharge chamber housing 16' has a discharge throat 28' established between a lower generally horizontal edge surface 26' of the support plate 22' and a planar discharge throat plate 124 suitably affixed to the base plate 20' such that the upper surface of the throat plate 124 is co-planar with the upper surface 24' of the base plate 20. The throat plate 124 may extend rearwardly from a plane containing rearward edge surfaces 126 on the end plates 116 and has a generally flat elongated flexible seal member 56' underlying the throat plate 124. The seal member 56' contacts the peripheral surface of the cylinder mold 12' and prevents discharging fibrous stock suspension from passing between the peripheral surface of the cylinder mold 12' and the inclined lower surface 52' of the base plate 20'. The discharge throat 28' is approximately ½ inch in height, considered between the surface 26′ and the throat plate 124, but may be varied by adjustment of the plate 128 on the support plate 22′.

The head box means 110 includes lid means 60′ which includes a lid element 62′ having a concave transverse cross-sectional configuration relative to the cylinder mold 12′ identical to the above described lid element 62. The mounting of the lid element 62′ differs from the mounting of the lid element 62 through the mechanism for varying the spatial relationship of the lid element 62′ relative to the peripheral surface of the cylinder mold 12′. The head box means 110 includes means for adjusting the profile of the trailing edge 66′ of the lid element 62′ relative to the surface of the mold 12′ to compensate for variations from a true cylindrical surface on the cylinder mold 12′ and may result from wear or manufacturing tolerances.

A pivot shaft 68′ having a longitudinal length substantially equal to the longitudinal length of the lid element 62′ is secured to the upper surface of the lid element adjacent its leading edge 70′ by suitable means such as welding or the like. The pivot shaft 68′ is pivotally secured to a transverse support plate 128 by means of a support bar 130 and a guide bar 132, the guide bar 132 and support bar plate having suitable curved recesses therealong to capture the pivot shaft 68′ while allowing rotation thereof about its longitudinal axis.

The support plate 128 is secured to the support plate 22′ in a manner to allow selective adjustment of the support plate 128, and thus the pivot shaft 68′, generally vertically along the rearward surface of the support plate 22′ in similar fashion to the adjustability of the above described support bar 73. In this manner, the leading portion of the lid element 62′ adjacent its leading edge 70′ may be adjusted to vary the spatial relationship between the leading portion of the lid element 62′ and the peripheral surface of the mold cylinder 12′.

To further selectively vary the spatial relationship of the lid element 62′ relative to the peripheral surface of the mold cylinder 12′, a plurality of brackets 134 are secured to the upper surface of the lid element 62′ in spaced relation along its longitudinal length, the brackets 134 being disposed at approximately mid-width of the lid element 62′, when considered in FIG. 4. Each bracket 134 rotatably supports a screw block 136 therebetween by means of axially aligned trunnion shafts 138 which are secured to each of the screw blocks 136 and rotatably received within axially aligned bores in the associated brackets 134. Each of the screw blocks 136 has a threaded bore 140 therethrough which receives the threaded lower end portion of a screw shaft 142. Each of the screw shafts 142 is rotatable within a bore 144 in a pivot block 146. Each pivot block 146 is maintained in fixed axial relation on the associated screw shaft 142 by upper and lower annular retainer rings 148 affixed to the respective screw shafts by set screws 150. Each pivot block 146 further has a pair of axially aligned pivot pins 152 secured thereto which are rotatably received within and supported by associated pairs of arms 154 affixed in normal relation to a horizontal pivot shaft 156 which extends the full longitudinal length of the lid element 62′. With particular reference to FIG. 6, the pivot shaft 156 is supported for rotational movement about its longitudinal axis by a plurality of pairs of support brackets 158 which are secured, as by mounting screws 160, in normal relation to the transverse support plate 128.

Each of the screw shafts 142 has a handle or knob 161 secured to its upper end such that manual rotational movement of the knobs 161 will effect a corresponding rotational movement of the associated screw shafts 142 to raise and lower the lid element 62′ relative to the support arms 154. The brackets 134 and associated screw shafts 142 are mounted along the length of the lid element 62′ in predetermined spaced relation, such as on 4 inch centers, such that selective rotation of the screw shafts 142 will vary the profile of the lid elements 62′, and particularly the trailing edge 66′, relative to the peripheral surface of the cylinder mold 12′, when considering the lid element in rear elevation.

The lid element 62′ is also adjustable as a unit relative to the peripheral surface of the mold cylinder 12′ through selective rotational movement of the pivot shaft 156. To this end, a pair of control arms 162 are secured on each end of the pivot shaft 156 outwardly from the associated end plates 116 on the dispersion chamber housing 16′, only one end of the pivot shaft 156 being illustrated in FIGS. 4–6. The ends of each pair of control arms 162 opposite the pivot shaft 156 are pivotally connected to a trunnion block 164 by means of stub shafts 166 formed on the trunnion blocks 164 in axially aligned relation. Each of the trunnion blocks 164 has a threaded bore 168 therethrough which receives the threaded end portion of a control shaft 170.

With particular reference to FIGS. 5 and 6, each control shaft 170 is rotatably received through and supported by a support bracket 172 which is pivotally supported on a cross shaft 182 having a reduced diameter end portion 181. The cross shaft 182 is received through and rotatable within suitable openings in the end plates 116. The control shafts 170 are maintained in fixed axial relation on their respective support brackets 172 by pairs of annular retaining elements 174 fixed to the control shafts 170. A bevel gear 176 is secured to the uppermost end of each screw shaft 170 and is in meshing relation with a bevel gear 178 fixed on the end portion 180 of the cross shaft 182. A control knob 184 is fixedly secured on each end 180 of the cross shaft 182 such that manual rotation of either of the control knobs 184 will effect rotation of the control shafts 170 to rotate the pivot shaft 156 about it longitudinal axis to selectively raise or lower the lid element 62′ and vary the spatial relationship between the lid element 62′ and the peripheral surface of the mold cylinder 12′.

The head box means 110 includes means to adjust for any warpage of the base plate 20′ or dispersion chamber housing 16′ during operation. To this end, a plurality of upstanding rigid brackets 186 are secured in upstanding spaced relation along the longitudinal length of the base plate 20′. The upper end of each of the rigid brackets 186 supports a bolt 188. The threaded end portion of each bolt 188 is received in threaded engagement within a threaded bore 190 in a plate 192 affixed to the upper chamber plate 118 and the support plate 22′ by screws 194 and 196. A plurality of the plates 192, corresponding in number to the rigid brackets 186, are secured along the upper surface of the chamber plate 118 and are spaced from the upper ends of the corresponding brackets 186. A nut 193 is threadedly mounted on each of the bolts as shown in FIG. 4. The bolts 188 may be selectively rotated to draw the plates 192 toward the rigid brackets 186, or the bolts 188 may be rotated to positions wherein the bolt heads are spaced from the associated brackets 186 while the threaded ends are still engaged within the tapped bores 190, whereupon the nuts 193 may be rotated against the brackets 186 to increase the spacing between the brackets 186 and the plates 192. In this manner, compensation for possible deflection due to pressure within the dispersion chamber 14 is provided. For example, if during operation either the base plate 20' or dispersion chamber housing 16' should warp or deflect to change the desired spacing of the base plate surface 52' and/or the lid element 62' relative to the peripheral surface of the cylinder mold 12', the bolts 188 may be adjusted to draw the surface 152' or lid element 62' away from the peripheral surface of the cylinder mold or move them closer to the mold surface. In other respects, the mounting and basic operation of the head box means 110 is substantially identical to that of the above described head box means 10.

In the above description of the head box means 10 and 110 in accordance with the present invention, the structure encompassed within the term "head box means" might alternatively be referred to as a "pressurized head box" or a "pressurized flow distribution box". Each of the discharge throats 28 and 28' might alternatively be referred to as a "fixed slice opening." The pressurized stock formation area 64 might alternatively be referred to as a "pressurized slice chamber" downstream of the slice opening. Further, each of the lid elements 62 or 62' might alternatively be referred to as a "control lid" or "slice lip."

While preferred embodiments of the present invention have been illustrated and described, it will be understood to those skilled in the art that changes and modifications may be made therein without departing from the invention in its broader aspects. Various features of the present invention are set forth in the following claims.

What is claimed is:

1. In a papermaking machine of the cylinder type having a rotatable cylinder mold upon which fiber stock is deposited for forming a continuous fibrous web, the combination therewith comprising head box means supported adjacent said cylinder mold and including a dispersion chamber housing defining an internal stock dispersion chamber, said housing having an inlet for introducing fibrous stock into said internal chamber and having an elongated outlet located to deposit fibrous stock under pressure from said chamber onto the peripheral surface of said cylinder mold, said head box means further including a unitary curved lid element having a leading edge pivotally connected to said housing adjacent said outlet and having a trailing edge extending downstream from said outlet such that said lid element is in concave spaced relation to said cylinder mold, adjustment means secured to said lid element at a position intermediate said leading and trailing edges and operable to adjust selectively the spaced relation of said lid element to said cylinder mold, said unitary lid element being sufficiently rigid to facilitate positioning of said lid element relative to said cylinder mold by said adjustment means to establish a pressurized stock formation area between said lid element and said cylinder mold but having a free cantilevered trailing edge portion spaced downstream from said adjustment means sufficient for predetermined flexing to vary the spatial relation of said cantilevered trailing edge portion to said cylinder mold in response to pressure changes within said stock dispersion chamber and to accommodate out-of-round cylinder molds, and at the same time maintain a substantially stable pressure within said pressurized stock formation area between said lid element and said cylinder mold from said outlet to said trailing edge of said lid element.

2. The combination as defined in claim 1 wherein said outlet and said lid element extend substantially the full longitudinal length of said cylinder.

3. The combination as defined in claim 1 wherein said lid element is made of stainless steel having a thickness suitable to allow said predetermined flexing of said trailing edge portion to maintain a substantially stable pressure within said stock formation area.

4. The combination as defined in claim 3 wherein the rearward downstream edge of said cantilevered portion of said lid element is spaced between approximately zero and 0.110 inch from the peripheral surface of said cylinder mold during non-operating conditions.

5. The combination as defined in claim 1 wherein said lid element is made of a material having flexure characteristics which will maintain the trailing edge of said cantilevered portion of said lid element spaced from the peripheral surface of said cylinder mold a distance within the range of between approximately 0.010 and 0.110 inch when said trailing edge is initially set between approximately zero to 0.110 inch from said cylinder mold before start-up and when the pressure within said internal chamber is maintained between approximately 5 to 30 inches water during operation.

6. The combination of claim 1 wherein said dispersion chamber housing includes wall means therein defining a restricted flow path through which the fiber stock is caused to flow, said flow path having a generally inverted U-shape with said inlet introducing fibrous stock into one end of said inverted U-shaped path and said outlet discharging fibrous stock from the opposite end of said path, said flow path having continuous boundary surfaces between said inlet and outlet which define alternatively converging and diverging flow areas to maintain turbulence in the fiber stock as it passes through said path.

7. The combination of claim 1 including support plate means supported by said housing in a plane substantially perpendicular to the direction of flow of fibrous stock from said outlet and adjustable relative to said housing, said leading edge of said lid element being pivotally supported by said support plate means, said support plate means being adjustable to selectively vary the effective slice opening.

8. The combination of claim 1 wherein said adjustment means for varying the spatial relation of said lid element to said cylinder mold includes a plurality of individually adjustable bracket means disposed along the longitudinal length of said lid element and operable to adjust said trailing edge of said lid element to conform substantially to the profile of said cylinder mold.

9. The combination of claim 1 wherein said dispersion chamber housing has a base plate supported adjacent the cylinder mold, at least one rigid bracket secured to said base plate in substantially perpendicular relation thereto and adjacent but spaced from a portion of said dispersion chamber housing, and including adjustable means interconnecting said rigid bracket to said portion of said dispersion chamber housing and adjustable to vary the spatial relationship between said rigid bracket and said portion of said dispersion chamber housing in a manner to compensate for warpage of said dispersion chamber housing during operation.

* * * * *